US008232485B2

(12) United States Patent
Chen et al.

(10) Patent No.: US 8,232,485 B2
(45) Date of Patent: Jul. 31, 2012

(54) KEY ASSEMBLY FOR AN ELECTRONIC DEVICE HAVING A MULTI-CHARACTER KEYCAP

(75) Inventors: Chao Chen, Waterloo (CA); Steven Andrew Prsa, Kitchener (CA); Joseph Michael Hofer, Waterloo (CA); Michael Welker, Waterloo (CA); Todd Andrew Wood, Guelph (CA)

(73) Assignee: Research In Motion Limited, Waterloo (CA)

( * ) Notice: Subject to any disclaimer, the term of this patent is extended or adjusted under 35 U.S.C. 154(b) by 365 days.

(21) Appl. No.: 12/567,926

(22) Filed: Sep. 28, 2009

(65) Prior Publication Data

US 2011/0073454 A1 Mar. 31, 2011

(51) Int. Cl.
*H01H 13/70* (2006.01)

(52) U.S. Cl. ..... 200/5 A; 200/516

(58) Field of Classification Search ..... 341/22; 345/168–170; 400/472, 473, 485–496; 200/5 A, 200/511, 512, 516, 517, 341
See application file for complete search history.

(56) References Cited

U.S. PATENT DOCUMENTS

| | | | | |
|---|---|---|---|---|
| 3,826,885 | A * | 7/1974 | Allen et al. | 200/534 |
| 4,323,740 | A * | 4/1982 | Balash | 200/5 A |
| 4,839,474 | A | 6/1989 | Hayes-Pankhurst et al. | |
| 5,228,561 | A | 7/1993 | Schroeder | |
| 5,231,386 | A | 7/1993 | Brandenburg | |
| 5,481,263 | A * | 1/1996 | Choi | 341/20 |
| 5,793,605 | A | 8/1998 | Sellers | |
| 5,848,152 | A | 12/1998 | Slipy et al. | |
| 6,040,821 | A | 3/2000 | Franz et al. | |
| 6,274,825 | B1 | 8/2001 | Aaltonen et al. | |
| 6,824,321 | B2 | 11/2004 | Ward et al. | |
| 6,864,881 | B2 * | 3/2005 | Lee | 345/168 |
| 6,931,125 | B2 | 8/2005 | Smallwood | |
| 7,041,924 | B2 * | 5/2006 | Jeschke et al. | 200/302.2 |
| 7,070,349 | B2 | 7/2006 | Dombrowski et al. | |
| 7,164,088 | B1 * | 1/2007 | Yurochko et al. | 200/5 A |
| 7,259,339 | B1 | 8/2007 | Babella | |
| 7,360,957 | B2 | 4/2008 | Dombrowski et al. | |
| 7,504,967 | B2 * | 3/2009 | Griffin | 341/22 |
| 7,579,561 | B2 * | 8/2009 | Wee et al. | 200/5 A |
| 7,864,513 | B2 * | 1/2011 | Chen | 361/679.08 |

(Continued)

OTHER PUBLICATIONS

Eeco Elastomer Series, Silicone Rubber Keypads (www.eecoswitch.com/PDF%20Files/Elastomer%20Keypads.pdf)—Downloaded May 4, 2009.

(Continued)

*Primary Examiner* — Michael Friedhofer
(74) *Attorney, Agent, or Firm* — Ridout & Maybee LLP

(57) ABSTRACT

A key assembly for use in an electronic device is provided. The key assembly includes a plurality of dome switches and a plurality of single-piece keycaps. Each keycap identifies a row of keyboard characters. Each keycap has a plurality of character-representing portions separated by deforming portions. Each character-representing portion is associated with a separate one of the plurality of dome switches. The key assembly further comprises a plurality of actuators for activating the dome switches. Each actuator has a first side which is engaged by one of the character representing portions of the keycap. Each actuator has a second side which engages the dome switch associated with that character-representing portion. In a rest state in which the keycap is not depressed, at least some of the actuators preload at least some of the dome switches by exerting a force upon the dome switches.

21 Claims, 8 Drawing Sheets

U.S. PATENT DOCUMENTS

| | | | | |
|---|---|---|---|---|
| 7,928,963 | B2 * | 4/2011 | Chang et al. | 345/169 |
| 7,982,715 | B2 * | 7/2011 | Lawton et al. | 345/168 |
| 2005/0281605 | A1 | 12/2005 | Dombrowski et al. | |
| 2007/0209913 | A1 * | 9/2007 | Clegg et al. | 200/5 A |
| 2008/0031673 | A1 | 2/2008 | Chang et al. | |
| 2008/0060928 | A1 | 3/2008 | Babella | |
| 2009/0107816 | A1 * | 4/2009 | Chen et al. | 200/314 |

OTHER PUBLICATIONS

U.S. Appl. No. 12/393,153, filed Feb. 26, 2009 to which RIM is an assignee (Unpublished).

* cited by examiner

KEY ASSEMBLY FOR AN ELECTRONIC DEVICE HAVING A MULTI-CHARACTER KEYCAP

TECHNICAL FIELD

The present disclosure relates generally to input devices, and more particularly to key assemblies for handheld electronic devices, and more particularly to a key assembly for a handheld electronic device having a multi-character keycap.

BACKGROUND

Keypad and keyboard designs in handheld electronic devices attempt to balance several design constraints which often include the ability to provide illuminated keys, a visual separation between keys, a tactile separation between keys, tactile feedback to device users in response to a key press, and providing such features within a relatively thin device profile.

Modern keypad and keyboard designs often utilize dome switches rather than mechanical "hard closing" switches to provide a thinner device profile. Depending on the keypad or keyboard design which is used, the use of dome switches may result in keys which are wobbly and unstable, and more prone to damage. In view of these and other deficiencies in keypad and keyboard designs, there remains a need for improved key assemblies for handheld electronic devices.

BRIEF DESCRIPTION OF THE DRAWINGS

Like reference numerals are used in the drawings to denote like elements and features.

DETAILED DESCRIPTION OF EXAMPLE EMBODIMENTS

Figure 1:
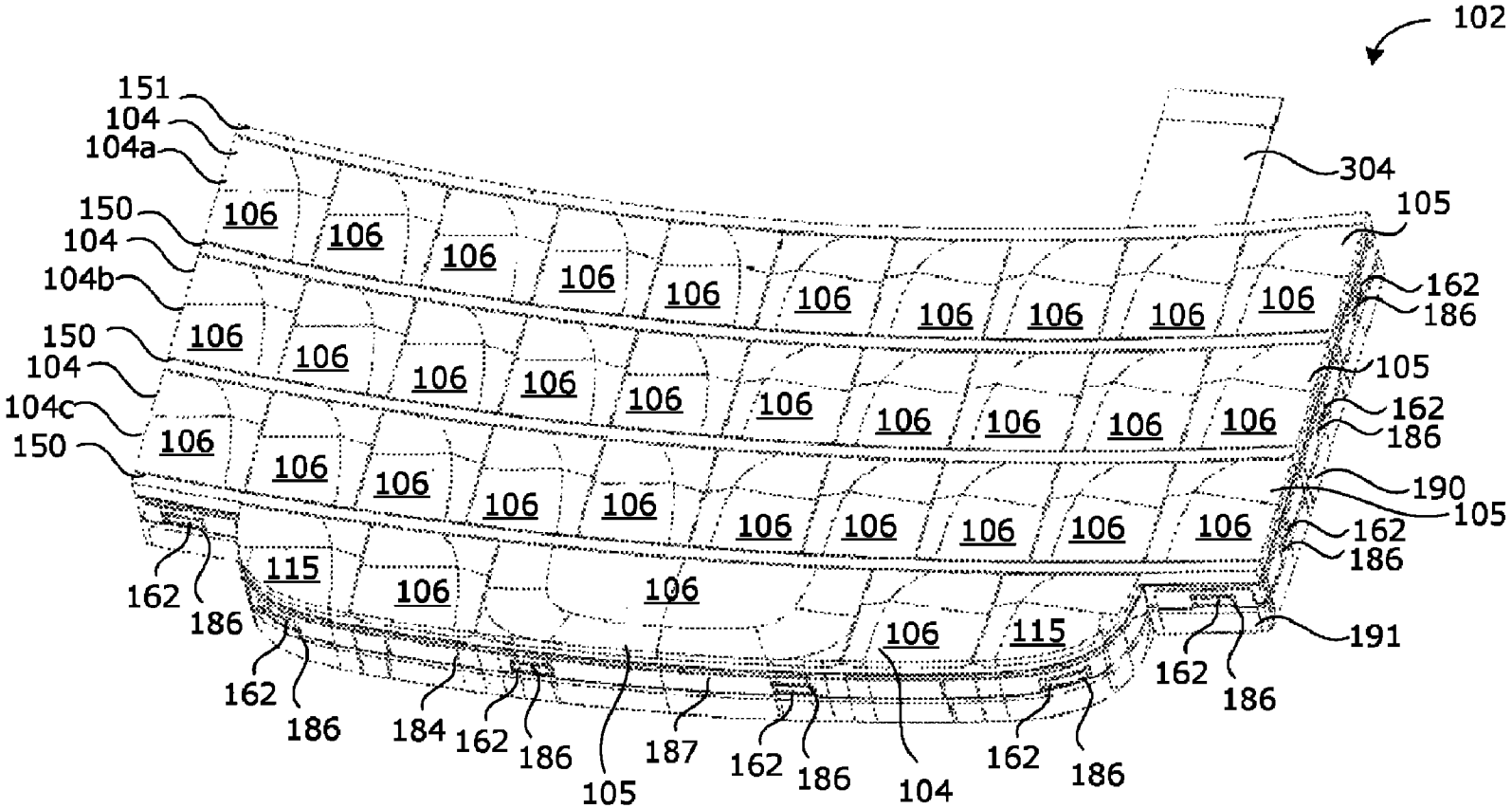
FIG. 1 is a perspective view of a key assembly in accordance with one example embodiment of the present disclosure.

The present disclosure provides a key assembly for use in an electronic device. The key assembly includes a plurality of dome switches and a plurality of single-piece keycaps. Each keycap identifies a row of keyboard characters. Each keycap has a plurality of character-representing portions separated by deforming portions. Each character-representing portion is associated with a separate one of the plurality of dome switches. The key assembly further comprises a plurality of actuators for activating the dome switches. Each actuator has a first side which is engaged by one of the character representing portions of the keycap. Each actuator has a second side which engages the dome switch associated with that character-representing portion. In a rest state in which the keycap is not depressed, at least some of the actuators preload at least some of the dome switches by exerting a force upon the dome switches.

In another aspect, the present disclosure provides an electronic device. The electronic device includes a controller for controlling the operation of the device and a key assembly. The key assembly includes a plurality of dome switches and a plurality of single-piece keycaps. Each keycap identifies a row of keyboard characters. Each keycap has a plurality of character-representing portions separated by deforming portions. Each character-representing portion is associated with a separate one of the plurality of dome switches. The key assembly further comprises a plurality of actuators for activating the dome switches. Each actuator has a first side which is engaged by one of the character representing portions of the keycap. Each actuator has a second side which engages the dome switch associated with that character-representing portion. In a rest state in which the keycap is not depressed, at least some of the actuators preload at least some of the dome switches by exerting a force upon the dome switches.

The teachings of the present disclosure relate generally to portable electronic devices such as mobile (e.g., wireless) communication devices such as pagers, cellular phones, Global Positioning System (GPS) navigation devices and other satellite navigation devices, smartphones, wireless organizers and wireless personal digital assistants (PDA). The portable electronic devices could be a device without wireless communication capabilities such as a PDA, electronic gaming device, digital photograph album or picture frame, digital camera, or digital video recorder such as a camcorder. The portable electronic device may comprise a touchscreen display as well as a keypad. These examples are intended to be non-limiting. It is also possible that the teachings of the present disclosure could be applied to electronic devices other than handheld electronic devices such as notebook computers.

Reference is first made to FIGS. 1 to 10 which illustrate a key assembly 102 for use in an electronic device in accordance with one embodiment of the present disclosure. In FIGS. 1 to 10, example features have been illustrated by reference numerals. In some figures, where there are multiple instances of the same feature, in order to enhance the readability of the figures, only a subset of these features have been numbered. For example, in FIGS. 5 and 6, there exists a plurality of actuators 140. In order to increase the readability of this drawing, only two such actuators 140 have been labelled.

The key assembly 102 comprises a plurality of single-piece keycaps 104 formed of a rigid material. Each keycap 104 is associated with and identifies a complete row of keyboard characters. The keyboard may be a QWERTY, QWERTZ, AZERTY, or Dvorak keyboard.

By way of example, in embodiments in which the keyboard is a QWERTY keyboard, a first keycap 104*a* (FIG. 1) may be associated with and identify the complete row of keyboard characters which includes the characters: 'Q', 'W', 'E', 'R', 'T', 'Y', 'U', 'I', 'O', and 'P'. Similarly, a second keycap 104*b* (FIG. 1) may be associated with and identify the complete row of keyboard characters which includes the characters: 'A', 'S', 'D', 'F', 'G', 'H', 'J', 'K', and 'L'. A third keycap 104*c* (FIG. 1) may be associated with and identify the complete row of keyboard characters which includes the characters: 'Z', 'X', 'C', 'V', 'B', 'N', and 'M'.

The characters associated with the keycaps 104 include letters that are used to write in a given language. For example, the characters may include letters of the English alphabet. In some embodiments, the characters are an alphanumeric character set that includes letters and numbers.

The characters associated with the keycaps 104 may be identified on the keycaps 104 in a number of ways. For example, in some embodiments, the characters are identified by a visual identifier such as in-mould labelling ("IML") of the keycap 104. In other embodiments, the characters are identified by in-mould decoration ("IMD") of the keycap 104. It will, however, be appreciated that other suitable labelling techniques may also be used to identify the characters associated with the keycap 104.

Each keycap 104 has a plurality of character-representing portions 106 aligned in a single row along the keycap. Each character-representing portion 106 is associated with and identifies at least one keyboard character. In some embodiments, each character-representing portion 106 is associated with a single character. In other embodiments, a single character-representing portion 106 may be associated with multiple characters. For example, in some embodiments, a character-representing portion 106 may be associated with two characters. For example, a first character-representing portion 106 may be associated with the 'Q' and 'W' characters, a second character-representing portion associated with the 'E' and 'R' characters, and so on. In such embodiments, the handheld electronic device with which the key assembly 102 is used may have a predictive text engine. In response to the depression of a character-representing portion 106, the predictive text engine may be used to predict a desired character from the plurality of characters associated with that character-representing portion 106.

In at least some embodiments, the keycaps 104 may also include one or more function-key representing portions 115. These portions may be associated with a specific function of the electronic device in which the key assembly 102 operates. For example, the function-key representing portions 115 may include a graphic or other identifier which is used to identify to a user the specific function assigned to that function-key representing portion 115. By way of example and not limitation, one of the function-key representing portions 115 may be associated with an additional-character function (not shown). When the additional-character function is activated, the device displays a plurality of non-standard characters on a display screen. The non-standard characters are characters which may not have an associated character-representing portion. For example, the non-standard characters may include the '@', '$', or '%' characters. When the non-standard characters are displayed on the display screen, a user may select one of the non-standard users by interacting with an input mechanism associated with the device.

Since each keycap 104 contains a plurality of character-representing portions 106, the keycaps 104 may be more stable than traditional keycaps in which each keycap only includes a single character-representing portion 106. That is, by providing multiple character representing portions 106 on a single keycap 104, the keycap may be less wobbly than traditional keycaps.

Figure 2:
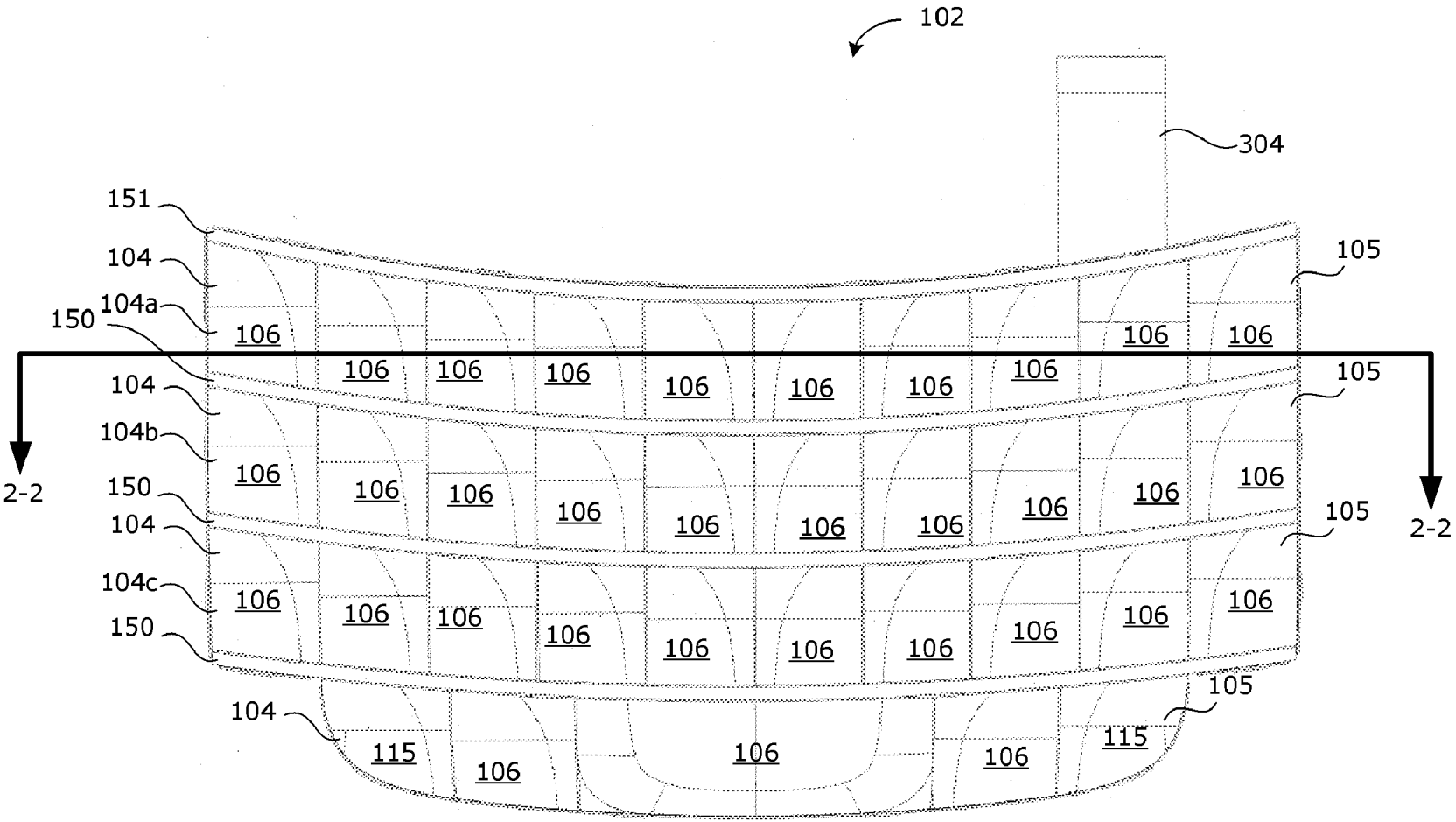
FIG. 2 is a top view of the key assembly of FIG. 1.
Figure 3:
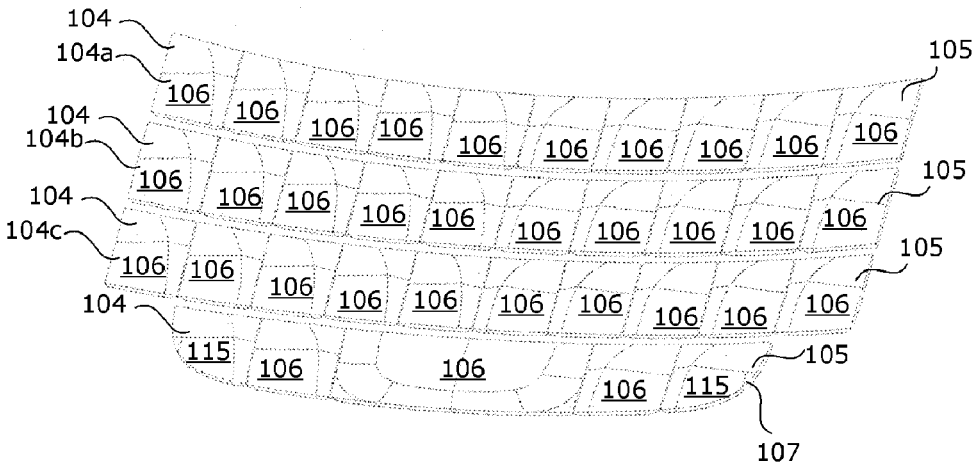
FIG. 3 is a perspective view of keycaps for use in the key assembly of FIG. 1 showing an externally facing side of the keycaps.
Figure 4:
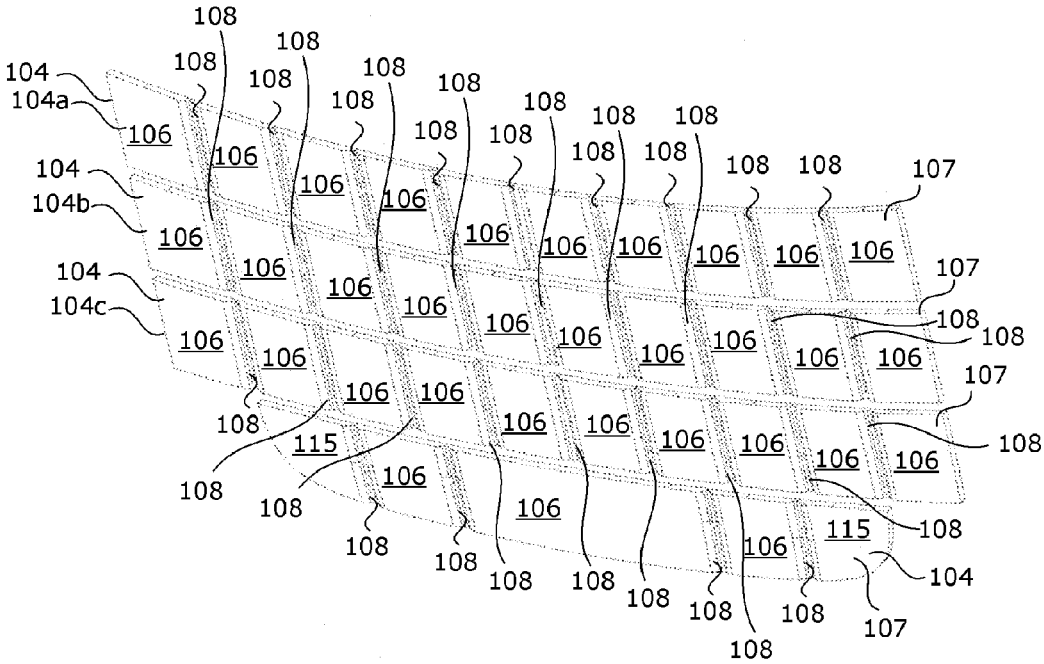
FIG. 4 is a perspective view of the keycaps of FIG. 3 showing an internally facing side of the keycaps.

The keycaps 104, in at least some embodiments, have an externally facing side 105 that includes tactile features, which are shown, for example, in FIGS. 2 and 3. More specifically, the tactile features may be included on the surface of the character representing portions 106. The tactile features may, for example, include an externally protruding portion or an indentation for assisting the user in navigating the keypad. The tactile features may provide tactile feedback to a user to assist that user in locating a desired character-representing portion 106. That is, the tactile features may be used to assist a user in determining the boundaries of a character-representing portion 106.

Each keycap 104 includes deforming portions 108 (FIGS. 4, 6 and 7) which separate adjacent character-representing portions 106. In the shown embodiment of FIGS. 1 to 10, each character-representing portion 106 is separated by respective mechanically deforming portions 108. The deforming portions 108 act as a hinge to permit the keycap 104 to bend at the deforming portions 108.

In some embodiments, the deforming portions 108 (which may be seen in FIGS. 4, 6, and 7) of the keycap 104 have a cross section 111 (FIG. 7) that is thinner than a cross section 113 (FIG. 7) of the character-representing portions 106 of the keycap 104. In such embodiments, the mechanically deforming portions 108 may be grooves in the keycap as shown, for example, in FIGS. 1 to 10. In some embodiments, the grooves may be formed on one side of the keycap 104 as shown, for example, in FIGS. 1 to 10. In other embodiments, the grooves may be formed on opposed sides of the keycap 104. In some embodiments, the mechanically deforming portions 108 have a cross section 111 (FIG. 7) that is approximately 0.25 mm in thickness.

In some embodiments, the grooves may be provided on the externally facing side 105 of the keycap 104 to provide the dual functions of mechanical deformation to allow for key presses of the respective character-representing portions 106 of the keycap 104, and visual or tactile separation between character-representing portions 106 of the keycap 104 for key identification by device users.

In another embodiment, the grooves are provided on an internally facing side 107 of the keycap 104 to provide mechanical deformation to allow for key presses of the respective character-representing portions 106 of the keycap 104.

In some embodiments where the grooves are provided on the internally facing side 107, the externally facing side 105 does not have grooves to define the limits of the character-representing portions 106 of the keycap 104. In such embodiments, the externally facing side 105 of the deforming portion 108 of the keycap 104 may have a surface which is level and/or continuous with the surface of the externally facing side 105 of the character-representing portion 106 which is adjacent to that deforming portion 108. That is, the externally facing side 105 may have no grooves at the deforming portion 108. In such embodiments, the externally facing side 105 may have no sharp transitions in gradient. Avoiding such sharp gradient transitions on the externally facing side 105 (such as grooves) may, in some embodiments, be used to prevent the accumulation of debris in the key assembly 102.

In embodiments where the externally facing side 105 does not have grooves, visual and tactile indications of the individual character-representing portions 106 of the keycap 104 may be provided by other means; for example, through the use of other tactile features on the character-representing portions 106 of the keycap 104 as described above.

The character-representing portions 106 and the deforming portions 108 of the keycap 104 are formed of a common material. In some embodiments, the character-representing portions 106 and the deforming portions 108 are formed of a rigid plastic, such as a polycarbonate, although it is recognized that alternate materials with similar properties may be appropriate.

Figure 5:
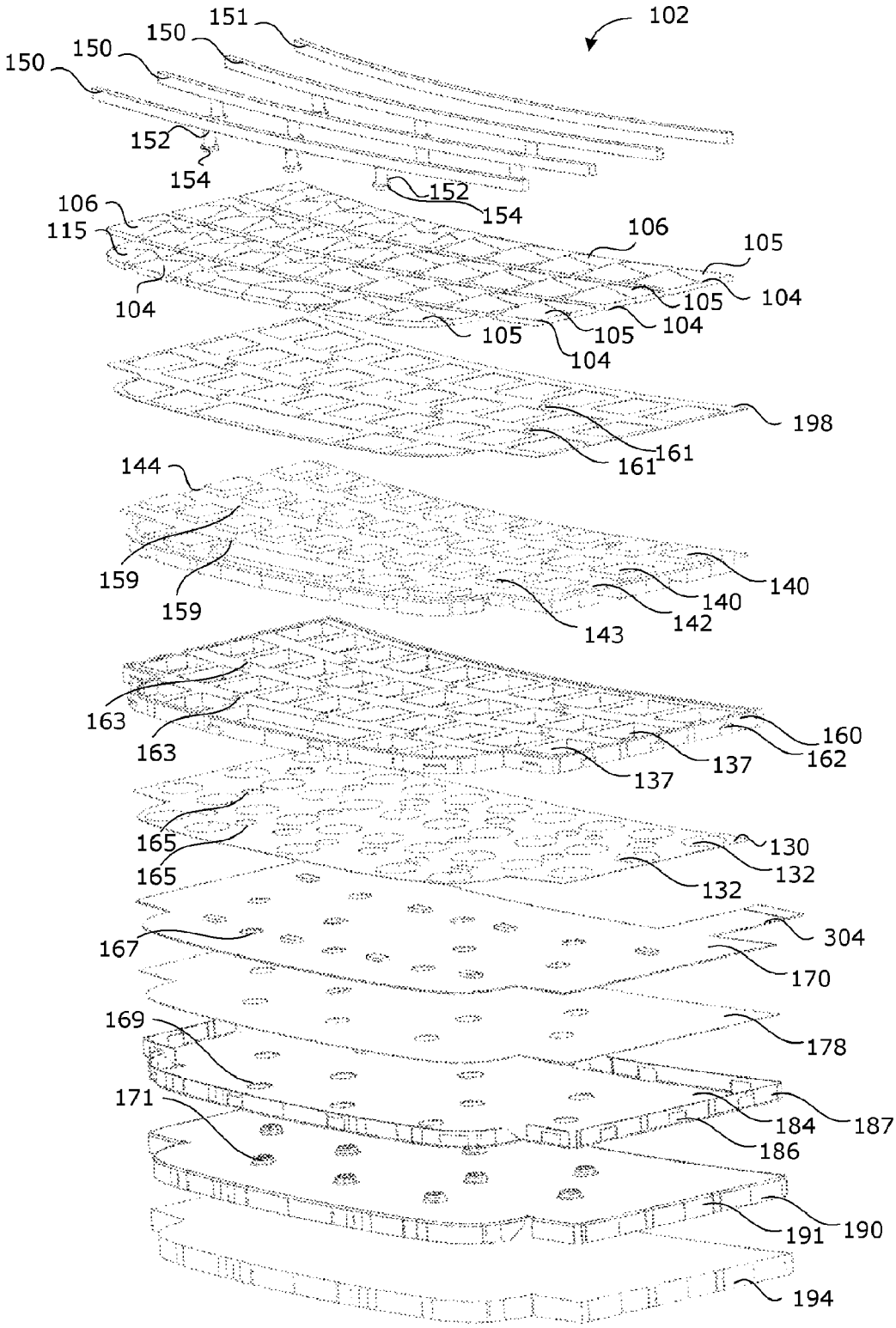
FIG. 5 is an exploded top view of the key assembly of FIG. 1.
Figure 6:
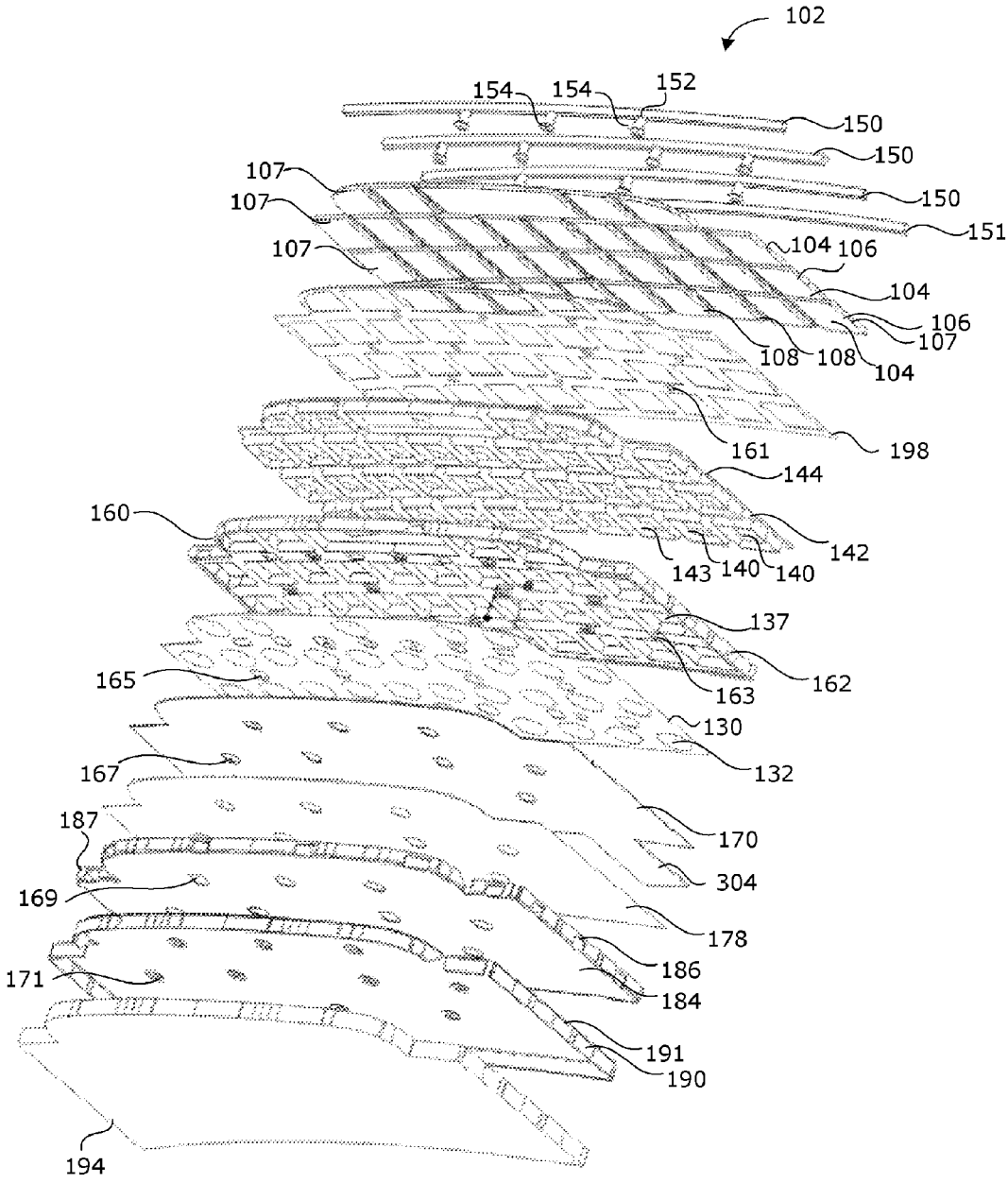
FIG. 6 is an exploded bottom view of the key assembly of FIG. 1.
Figure 7:
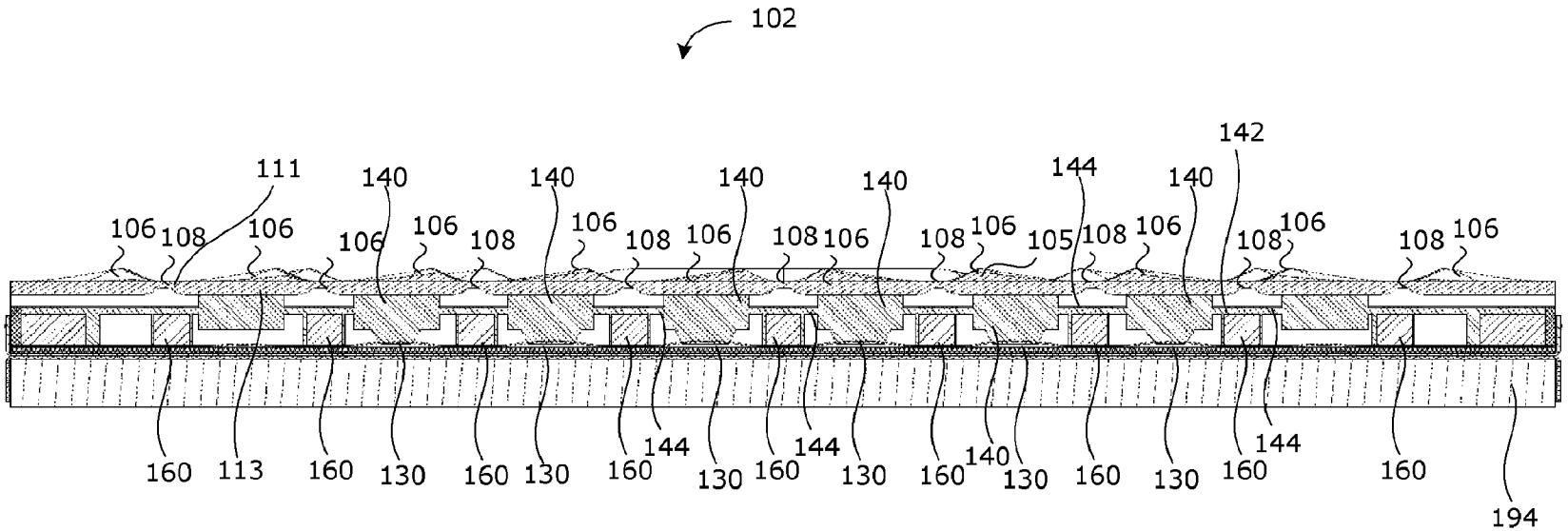
FIG. 7 is a sectional view of the key assembly of FIG. 1 taken along the line 2-2 of FIG. 2.

The key assembly 102 also includes a plurality of dome switches 132. Each character-representing portion of the keycap 104 is associated with a separate one of the dome switches 132 (FIGS. 5 and 6). The dome switches 132 may be included on a dome sheet 130 which mechanically connects the dome switches 132 together to provide stability to the dome switches 132 and to hold the dome switches 132 in place within the key assembly 102.

In some embodiments, each dome switch 132 comprises a polyethylene terephthalate (PET) film which overlays a collapsible metal dome having a nickel plating over a gold plating on a flexible printed circuit board (PCB). As will be explained in greater detail below, when a character representing portion 106 is pressed, the dome of the respective dome switch collapses thereby connecting conductive platings on an adjacent printed circuit board ("PCB") 170 and completing a connection therebetween. The PCB 170 includes an electrical connector 304 which may be used to connect the PCB 170 to a controller of a host electronic device. In the embodiment shown, the electrical connector 304 is a ribbon connector. The controller of the host electronic device receives an input signal in response to the connection of the conductive platings caused by actuation of the dome switch 132. The controller recognizes a corresponding input in response to the received input signal. In other embodiments, other dome switch constructions could be used.

The key assembly 102 further comprises a plurality of actuators 140 (FIGS. 5, 6, 7) for activating the dome switches 132. Each actuator 140 actuates a different one of the dome switches 132. Further, each actuator 140 is associated with a different one of the character-representing portions 106 or the function key representing portions 115. In the embodiment shown, each character-representing portion 106 is associated with a single actuator 140. The actuator 140 has a first side 141 (which is illustrated in FIG. 6) which engages the associated character-representing portion 106 or function key representing portion 115. In some embodiments, the actuator 140 directly engages its associated character-representing portion 106 or function key representing portion 115; for example through direct contact. In other embodiments, the key assembly 102 may include a further layer (not shown) between the actuator 140 and the character-representing portions 106, and the character-representing portion 106 (or function key representing portion 115) engages the actuator 140 through this further layer. The actuator 140 engages the associated character-representing portion 106 (or function key representing portion 115) in the sense that a force applied to the externally facing side 105 of the character-representing portion 106 (or function key representing portion 115) is transferred, in whole or in part, to the actuator 140.

The first side of the actuator 140 is proportionally shaped to the interior side 107 of the associated character-representing portion 106 or function key representing portion 115 in order to provide proper support. The keycap 104 of the key assembly 102 may, in some embodiments, be connected to the first side of the actuators 140 using an adhesive, although it is appreciated that alternative materials with similar properties may be suitable.

The actuator 140 has a second side 143 (which is illustrated in FIG. 5) which opposes the first side 141 which engages the dome switch 132 associated with that actuator 140. The second side 143 may, in some embodiments, have a circular profile for contacting a circular dome switch 132. In some embodiments, the actuator 140 directly engages its associated dome switch 132; for example through direct contact. In other embodiments, the key assembly 102 may include a further layer (not shown) between the actuator 140 and the dome switch 132, where the dome switch 132 is engaged by the actuator 140 through this further layer. The actuator 140 engages the associated character-representing portion 106 (or function key representing portion 115) in the sense that a force applied to the externally facing side 105 of the character-representing portion 106 (or function key representing portion 115) is transferred, in whole or in part, to the actuator 140, which is then transferred, in whole or in part, to the dome switch 132.

The actuators 140 are provided on an actuator sheet 142 which includes a connecting web 144 between the actuators 140, which connects the actuators 140 together to provide stability and hold the actuators 140 in place within the key assembly 102. In the shown embodiment, the actuator sheet 142 connects all of the actuators 140. It will be appreciated, however, that in other embodiments, the actuators 140 or a subset thereof may be connected in other ways. For example, in some embodiments, a plurality of actuator sheets 142 may be used. In such embodiments, the actuator sheets 142 may connect the actuators 140, for example, in a row-wise or column-wise manner. In embodiments in which row-wise connections are used, each actuator sheet 142 may connect only the actuators 140 in a given row of the key assembly 102. That is, the actuators 140 which are associated with the character-representing portions 106 on a first keycap 104*a* may be connected together, but actuators 140 which are associated with the character-representing portions 106 on a second keycap 104*b* are provided in a separate actuator sheet. Similarly, where column-wise connections are used, each actuator sheet 142 may connect the actuators in a given column of the key assembly 102.

In some embodiments, the actuators 140 and the actuator sheet 142 may be formed of silicone rubber in order to permit the actuators 140 to compress. As will be explained in greater detail below, the compressing of the actuators 140 may, in some embodiments, be useful for applying a pre-loaded force to the dome switches 132 to reduce the force required to depress the dome switches. However, it will be appreciated that in other embodiments other materials may be used.

In some embodiments, the actuator sheet 142 or a portion thereof is comprised of a clear material which permits the transmission of light. The actuator sheet 142 may thus act as a light guide, permitting light generated on one side of the actuators 140 to travel to another side of the actuators 140. For example, in some embodiments, the PCB 170 includes one or more light generating elements, such as a light emitting diode ("LED"). The LEDs are located at positions which direct light through holes defined by the dome sheet 130 and the light is then passed by the actuator sheet 142 (which is, in at least some embodiments, co-moulded with a support 160 which may also be used to pass light and which is described in further detail below) to the keycaps 104, thus allowing the keycaps 104 to be illuminated.

Figure 11:
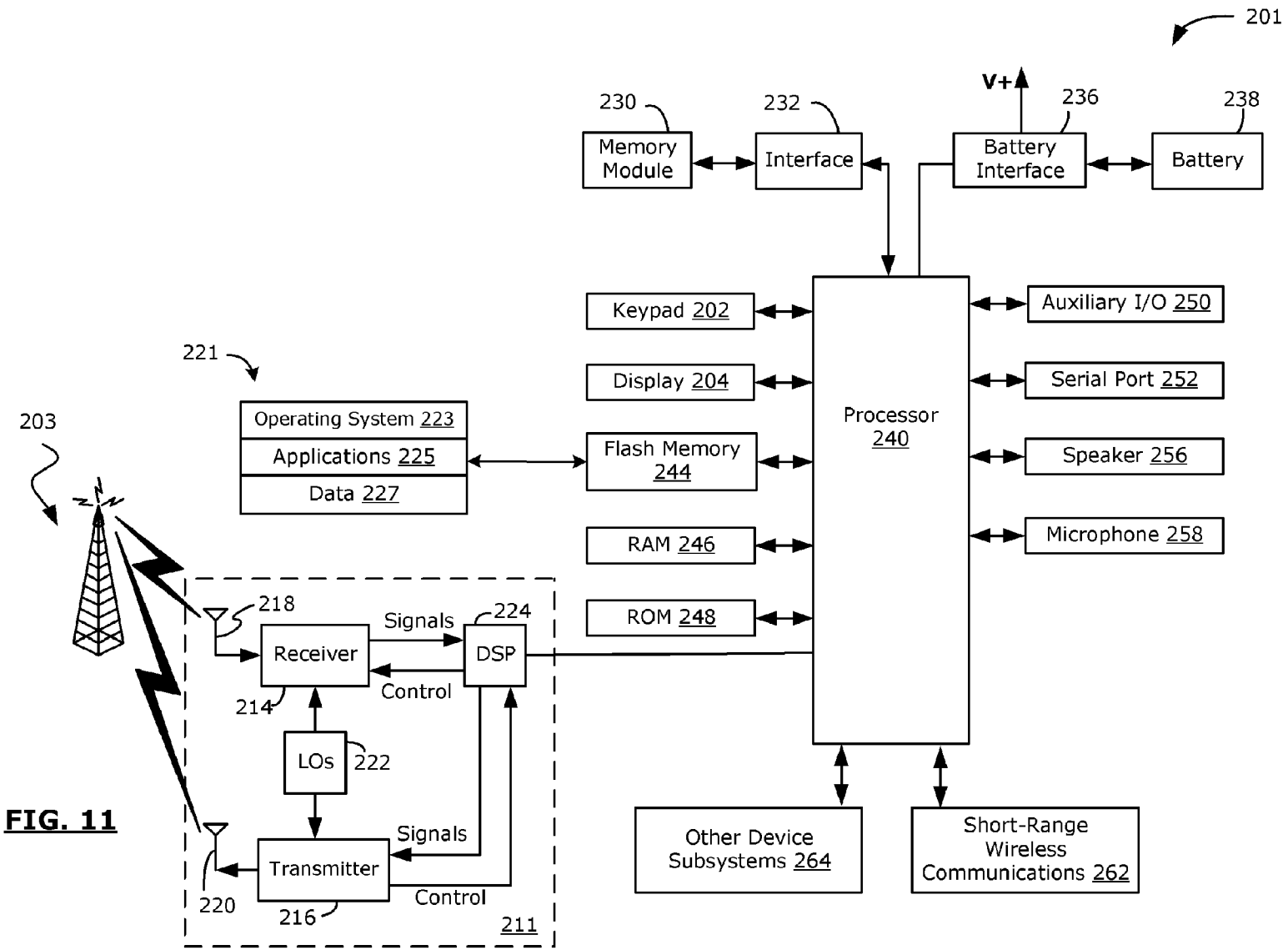
FIG. 11 is a block diagram illustrating a handheld electronic device in accordance with one example embodiment of the present disclosure.

In some embodiments, at least some of the character-representing portions 106 have a transparent portion or window for transmitting light from the light generating elements therethrough. In some embodiments, each of the character-representing portions 106 have a transparent portion for transmitting light therethrough to provide backlighting of the key portions. In at least some embodiments, the keycap 104 is formed of a rigid polycarbonate. In some embodiments, the keycap 104 is formed of a transparent material such as a light diffusing polycarbonate which is painted with a desired colour or colours and laser-etched to remove a portion of the paint and expose the transparent material for transmitting light therethrough. In some embodiments, the character-representing portions 106 are painted a first colour which will provide the backlight colour and then painted a second colour which, for example, matches a colour of the housing of the host electronic device 201 (FIG. 11). The second colour is then laser-etched in predefined shapes to expose the first colour. The predefined shape may be used to provide a visual representation which informs the device user of a function of the respective character-representing portions 106. The predefined shape is typically different for each character-representing portion 106. The first colour may vary between character-representing portions 106. When assembled into the host electronic device 201, activation of the LEDs on the PCB 170 backlights the respective character-representing portions 106 so as to illuminate the laser-etched shape in the respective background colour (e.g., the first colour).

In some embodiments, the key assembly 102 includes a support 160 which is disposed between the actuator sheet 142 and the dome sheet 130 and which supports the actuators 140.

The support 160 defines a plurality of openings 137 which receive the actuators 140 and which permit the actuators 140 to contact the dome switches 132 of the dome sheet 130. The support 160 is in contact with the connecting web 144 of the actuator sheet 142. Through its contact with the connecting web 144 of the actuator sheet 142, the support 160 supports the actuator sheet 142 in spaced relation above the dome sheet 132.

In some embodiments, the support may serve the dual purpose of supporting the actuator sheet 142 and acting as a further light guide. The support 160 may be constructed of a rigid plastic, which may be formed, for example, by plastic injection. That is, the support 160 may be formed of a rigid polycarbonate using injection moulding (which is polycarbonate L1225L in some embodiments). Where the support 160 also acts as a light guide, the support 160 is constructed of a material which is transparent or, in some embodiments, translucent. For example, the support 160 may be constructed of a clear plastic.

Due to the use of keycaps 104 which have more than one character-representing portion 106, the keycaps 104 in the key assembly 102 may be larger than standard keycaps. Due to the increased size of the keycaps 104, the keycaps 104 may, in some embodiments, be more difficult to depress than standard keycaps. In order to permit easier depression of the keycaps 104, in an unactivated or rest state in which no external forces are placed on the keycap 104 (for example, from a user), the actuators 140 are held in a position in which they pre-load the dome switches 132. That is, in a rest state, where the keycap 104 is not depressed beyond its natural resting position, at least some of the actuators 140 preload at least some of the dome switches 132 by exerting a force upon those dome switches 132. To accomplish this preloading, the actuators 140 are biased into a position in which they interfere with their associated dome switch 132 and in which they exert a force upon that dome switch 132. The force is greater than 10 grams. In some embodiments, the force is in the range of 20 to 60 grams. In some embodiments, the force is approximately 40 grams. The amount of force used to preload the dome switches 132 may vary based on the degree of rigidity of the dome switches 132. That is, the preloading force may vary with the force required to depress a dome on a dome switch in order to close that dome switch 132.

To accomplish such preloading of the dome switches, the support 160 supports the actuator sheet 142 and holds the actuators 140 in a position in which the actuators 140 exert a force upon their respective associated dome switches 132 when the key assembly 102 is in its rest position where no external forces are applied to the keycaps 104. In the rest state in which no external forces are applied to the keycap 104, the support 160 may 1) hold the actuators 140 in a position in which the dome switches 132 are partially depressed (FIG. 8); 2) hold the actuators 140 in a position in which the actuators 140 are forced upwardly away from the dome switches 132 as a result of the preloaded force between the dome switch 132 and the actuators 140 (FIG. 9); or 3) hold the actuators 140 in a position in which the actuators 140 are compressed (FIG. 10).

Figure 8:
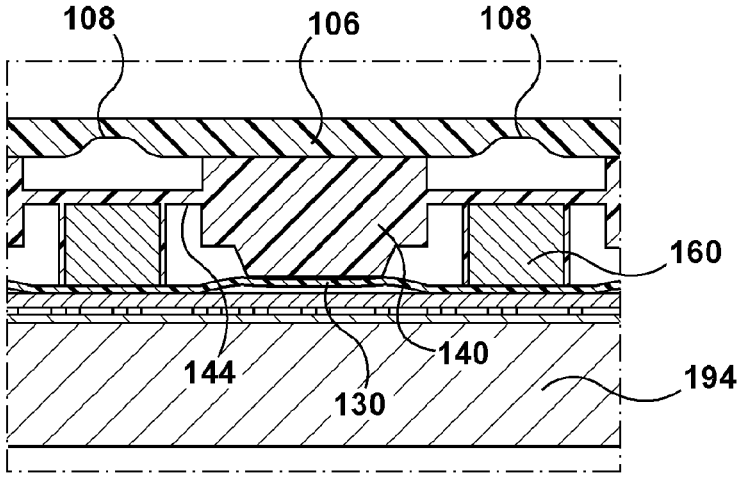
FIG. 8 is a partial cross sectional view of the key assembly of FIG. 1 taken along the line 2-2 of FIG. 2.

For example, as shown in FIG. 8, in some embodiments, the support 160 may hold the actuator 140 in a position in which the dome switch 132 is partially depressed in the rest state. In this position, the force required to depress the dome switch 132 need not be as large as in embodiments where there is no pre-loading of the dome switch.

Figure 9:
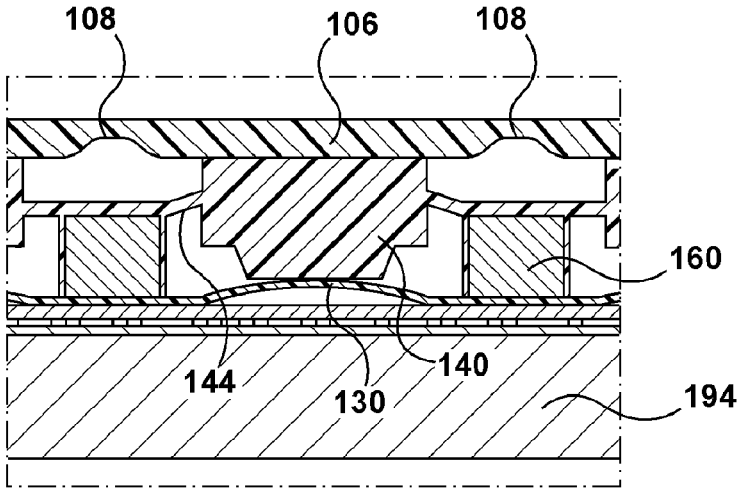
FIG. 9 is a partial cross sectional view of the key assembly of FIG. 1 taken along the line 2-2 of FIG. 2.

Similarly, as shown in FIG. 9, in some embodiments, the support 160 may hold the actuator 140 in a position in which the actuator 140 is forced upwardly away from the dome switches 132. In such embodiments, the connecting web 144 may deform to permit movement of the actuator 140.

Figure 10:
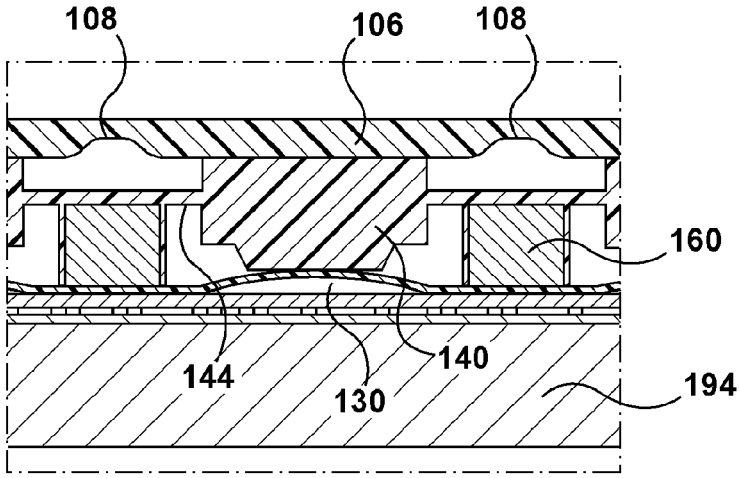
FIG. 10 is a partial cross sectional view of the key assembly of FIG. 1 taken along the line 2-2 of FIG. 2.

Similarly, in some embodiments, illustrated in FIG. 10, the support 160 may hold the actuator 140 in a position in which the actuator is partially compressed in the rest state. In such embodiments, the compressed actuator 140 preloads of the dome switch 132 due to the natural tendency of the actuator 140 to attempt to return to an uncompressed state. That is, the compression energy of the actuator 140 is applied to the actuator 140.

In various embodiments, any combination of these various resulting positions may occur in the rest state. For example, in some embodiments, in the rest state the dome switch 132 may be partially compressed and the actuator 140 may also be partially compressed.

It will be appreciated that preloading the dome switches 132 allows the dome switches 132 to be engaged with less force from a user than would be required in systems which do not include preloading. It will also be appreciated that the preloading of the dome switches 132 provides additional stability to the key assembly 102.

The specific position of the actuator 140 in the rest state will vary depending on the material properties of the dome switches 132, the actuators 140, and the connecting web 144 used to connect the actuators to the support. For example, in some embodiments, the actuator 140 is constructed of a compressible material such as rubber. In such embodiments, the actuator 140 may be compressed when in the rest state as a result of the preloaded force between the dome switch 132 and the actuators 140. In some embodiments, the connecting web may be constructed of an elastic material, such as rubber. In such embodiments, when in the rest state, the actuator 140 may be forced upwardly away from the dome switches 132 as a result of the preloaded force between the dome switch 132 and the actuators 140. When this occurs, the connecting web 144 is extended beyond its natural resting position, thereby creating elastic energy in the connecting web 144 which assists in the preloading of the dome switches 132.

It will be appreciated that other mechanisms apart from those described herein may be used to support the actuators 140 in a position in which they preload the dome switches 132.

In the shown embodiment, in order to connect the support 160 to the dome sheet 130, the support 160 has disposed around its perimeter a plurality of first connectors 162. These first connectors 162 physically connect the support 160 to the dome sheet 130.

The first connectors 162 connect with mated connecting features 186 on a back plate 184. More particularly, a back plate 184 or other support is disposed on the side of the dome sheet 132 that opposes the side on which the support 160 is located. The back plate 184 may be, but is not necessarily, located in a layer of the key assembly 102 which is adjacent to the dome sheet 130. For example, in the embodiment shown, the dome sheet 130 is adjacent to the PCB 170. An adhesive layer 178 is disposed between the PCB 170 and the back plate 184. The adhesive layer 178 connects the PCB 170 to the back plate 184.

The back plate 184 includes an edge 187 which extends upwardly in the direction of the dome sheet 130. Thus, the back plate acts as a housing for the dome sheet 130. The edge 187 has disposed thereon the connecting features 186 which mate with and connect to the first connectors 162 of the support 160. The first connectors 162 and its associated connecting features 186 thus connect the support 160 to the dome sheet 130.

Accordingly, in the embodiment shown, the support 160 is connected to the dome sheet by compression fitting the dome sheet 130 and the support 160. It will, however, be appreciated that other methods and connectors for connecting the support 160 to the dome sheet 130 may also be employed. For example, in some embodiments, the dome sheet 130 may be connected to the support 160 with an adhesive. Alternatively, in some embodiments, the support 160 may be integrated with the dome sheet 130 and formed as a single element.

The dome sheet 130, and, in some embodiments, the actuator sheet 142 are connected to the support 160 by way of one or more second connectors 150. In the embodiment shown, the second connectors 150 are comprised of elongate bars which are disposed between adjacent keycaps 104. In the shown embodiment, the second connectors 150 act as separating members to space adjacent keycaps 104. Such spacers may serve a number of functions including, for example, spacing the keycaps 104 in order to accommodate a user's fingers and prevent the accidental depression of an adjacent keycap. The second connectors 150 may also serve to act as a visual separator of adjacent keycaps 104. In such cases, the second connectors 150 may be a different colour than the keycaps 104.

In the shown embodiment, the second connectors 150 have one or more protrusions 152 thereon. The protrusions extend downwardly, towards the dome sheet 132 and may be received by corresponding holes 159 (FIG. 5) defined by the actuator sheet 142 and, in some embodiments, corresponding holes 161, 163, 165, 167, 169, 171 defined in a light shield layer 198, the support 160, the dome sheet 130, the PCB 170, the back plate 184 and/or a second back plate 190, respectively. It will be appreciated that some of these layers may not be included in some embodiments.

The protrusion 152 on the second connectors 150 has an enlarged end 154 which is larger than any of the holes 159, 161, 163, 165, 167, 169, 171. The enlarged end 154 may be formed by a heat staking process. Once the key assembly 102 is assembled, the enlarged end 154 holds the protrusion 152 in the holes 159, 161, 163, 165, 167, 169, 171. That is, the enlarged end 154 prevents the protrusion 152 from escaping the holes 159, 161, 163, 165, 167, 169, 171.

In the shown embodiment, the second connectors 150 are each aligned with at least a portion of the connecting web 144 of the support 160. The second connectors 150 thus hold the actuator sheet 142 against the support, thus holding the actuators 140 in a position in which a preload force is exerted on the dome switches 132.

In some embodiments, the key assembly 102 may further comprise a decorative spacer 151. The decorative spacer may be an elongate bar which resembles the second connectors 150. The decorative spacer 151 is disposed adjacent to one or more keycaps 104. In the shown embodiment, the decorative spacer 151 is parallel to each of the second connectors 150. The decorative spacer 151 differs from the second connectors 150 only in that the decorative spacer does not include the protrusions 152. The spacer 151 may be affixed to the key assembly 102 by way of an adhesive. It will be appreciated that the spacer 151 may be affixed to the key assembly 102 in other ways.

The actuator sheet 142 may be connected to the support 160 using other connectors or methods than those described above. In some embodiments, the actuator sheet 142 is co-moulded to the support 160. This may be done, for example, by compressing or injecting a first material (such as rubber, which may be used, for example, for the actuator sheet 142) to a second material (such as plastic or metal which may be used, for example, for the support 160). In other embodiments the actuator sheet 142 may be connected to the support 160 using an adhesive.

In the embodiment illustrated, the key assembly 102 also includes a light shield 198. The light shield 198 is an opaque layer which is disposed between the keycaps 104 and the actuator sheet 142 and serves to prevent light from escaping in undesirable locations. That is, the light shield 198 focuses any light on the character-representing portions 106 and any possible function-key representing portions 115 of the keycap 104.

The shown embodiment also includes a second back plate 190 disposed at a layer adjacent to the back plate 184. The second back plate 190 has an edge 191 which extends downwardly, away from the dome sheet 130. The second back plate 190 serves to house additional components 194. The additional components 194 may, for example, be a stiffening support which is used to provide structural support to the key assembly 102. In some embodiments, the back plate 184 and the second back plate 190 are metal layers. These metal layers are, in some embodiments, connected together; for example, by welding.

The key assembly 102 typically includes a mounting subassembly (not shown) for mounting the key assembly 102 to a host electronic device, for example, the handheld electronic device 201 described below.

While portions of the key assembly 102 are shown as separate elements, some of these elements may be combined in other embodiments or formed together using co-moulding in other embodiments. For example, in some embodiments, the actuator sheet 142 may be co-moulded with the support 160. It is also possible that some of the elements described as a single element may be implemented using multiple elements in other embodiments.

While the shown embodiment illustrated a key assembly 102 in which the actuator sheet 142 was connected to the support 160, which was connected to the dome sheet 130, in other embodiments, the actuator sheet 142, or the individual actuators 140 may be connected directly to the dome sheet 130. For example, the connecting web 144 of the actuator sheet 142 could be connected to the dome sheet 130.

Reference is now made to FIG. 11 which illustrates a handheld electronic device 201 in which example embodiments described in the present disclosure can be applied. The handheld electronic device 201 is a two-way communication device having data and voice communication capabilities, and the capability to communicate with other computer systems, for example, via the Internet. Depending on the functionality provided by the handheld electronic device 201, in various embodiments the device 201 may be a multiple-mode communication device configured for both data and voice communication, a smartphone, a mobile telephone or a PDA (personal digital assistant) enabled for wireless communication, or a computer system with a wireless modem.

The handheld electronic device 201 includes a rigid case (not shown) housing the components of the device 201. The internal components of the device 201 are constructed on, or connected via, a printed circuit board (PCB) (which may be the PCB 170). The handheld electronic device 201 includes a controller comprising at least one processor 240 (such as a microprocessor) which controls the overall operation of the device 201. The processor 240 interacts with device subsystems such as a wireless communication subsystem 211 for exchanging radio frequency signals with the wireless network 203 to perform communication functions. The processor 240 interacts with additional device subsystems including a display (screen) 204 such as a liquid crystal display (LCD) screen, a keypad 202 constructed using a key assembly in accordance with the present disclosure such as the key assembly 102 of FIGS. 1 to 10, possibly other input devices (not shown), flash memory 244, random access memory (RAM) 246, read only memory (ROM) 248, auxiliary input/output (I/O) subsystems 250, data port 252 such as serial data port, such as a Universal Serial Bus (USB) data port, speaker 256, microphone 258, short-range communication subsystem 262, and other device subsystems generally designated as 264. Some of the subsystems shown in FIG. 11 perform communication-related functions, whereas other subsystems may provide "resident" or on-device functions. In other embodiments, instead of the keypad 202, the handheld electronic device 201 may comprise a keyboard constructed using a key assembly in accordance with the present disclosure such as the key assembly 102 of FIG. 1. The device 201 may comprise a touchscreen display in some embodiments. The touchscreen display may be constructed using a touch-sensitive input side connected to an electronic controller and which overlays the display screen 204. The touch-sensitive overlay and the electronic controller provide a touch-sensitive input device and the processor 240 interacts with the touch-sensitive overlay via the electronic controller.

The communication subsystem 211 includes a receiver 214, a transmitter 216, and associated components, such as one or more antenna elements 218 and 220, local oscillators (LOs) 222, and a processing module such as a digital signal processor (DSP) 224. The antenna elements 218 and 220 may be embedded or internal to the handheld electronic device 201 and a single antenna may be shared by both receiver and transmitter, as is known in the art. As will be apparent to those skilled in the field of communication, the particular design of the wireless communication subsystem 211 depends on the wireless network 203 in which handheld electronic device 201 is intended to operate.

The handheld electronic device 201 may communicate with any one of a plurality of fixed transceiver base stations 108 of the wireless network 203 within its geographic coverage area. The handheld electronic device 201 may send and receive communication signals over the wireless network 203 after the required network registration or activation procedures have been completed. Signals received by the antenna 218 through the wireless network 203 are input to the receiver 214, which may perform such common receiver functions as signal amplification, frequency down conversion, filtering, channel selection, etc., as well as analog-to-digital (A/D) conversion. A/D conversion of a received signal allows more complex communication functions such as demodulation and decoding to be performed in the DSP 224. In a similar manner, signals to be transmitted are processed, including modulation and encoding, for example, by the DSP 224. These DSP-processed signals are input to the transmitter 216 for digital-to-analog (D/A) conversion, frequency up conversion, filtering, amplification, and transmission to the wireless network 203 via the antenna 220. The DSP 224 not only processes communication signals, but may also provide for receiver and transmitter control. For example, the gains applied to communication signals in the receiver 214 and the transmitter 216 may be adaptively controlled through automatic gain control algorithms implemented in the DSP 224.

The processor 240 operates under stored program control and executes software modules 221 stored in memory such as persistent memory, for example, in the flash memory 244. As illustrated in FIG. 11, the software modules 221 comprise operating system software 223 and software applications 225. Those skilled in the art will appreciate that the software modules 221 or parts thereof may be temporarily loaded into volatile memory such as the RAM 246. The RAM 246 is used for storing runtime data variables and other types of data or information, as will be apparent to those skilled in the art. Although specific functions are described for various types of memory, this is merely one example, and those skilled in the art will appreciate that a different assignment of functions to types of memory could also be used.

In some embodiments, the handheld electronic device 201 also includes a removable memory card 230 (typically comprising flash memory) and a memory card interface 232. Network access is typically associated with a subscriber or user of the handheld electronic device 201 via the memory card 230, which may be a Subscriber Identity Module (SIM) card for use in a GSM network or other type of memory card for use in the relevant wireless network type. The memory card 230 is inserted in or connected to the memory card interface 232 of the handheld electronic device 201 in order to operate in conjunction with the wireless network 203.

The handheld electronic device 201 stores data 227 in an erasable persistent memory, which in one example embodiment is the flash memory 244. In various embodiments, the data 227 includes service data comprising information required by the handheld electronic device 201 to establish and maintain communication with the wireless network 203. The data 227 may also include user application data such as email messages, address book and contact information, calendar and schedule information, notepad documents, image files, and other commonly stored user information stored on the handheld electronic device 201 by its user, and other data. The data 227 stored in the persistent memory (e.g. flash memory 244) of the handheld electronic device 201 may be organized, at least partially, into a number of databases each containing data items of the same data type or associated with the same application. For example, email messages, contact records, and task items may be stored in individual databases within the device memory.

The serial data port 252 may be used for synchronization with a user's host computer system (not shown). The serial data port 252 enables a user to set preferences through an external device or software application and extends the capabilities of the handheld electronic device 201 by providing for information or software downloads to the handheld electronic device 201 other than through the wireless network 203. The alternate download path may, for example, be used to load an encryption key onto the handheld electronic device 201 through a direct, reliable and trusted connection to thereby provide secure device communication.

In some embodiments, the handheld electronic device 201 is provided with a service routing application programming interface (API) which provides an application with the ability to route traffic through a serial data (i.e., USB) or Bluetooth® (Bluetooth® is a registered trademark of Bluetooth SIG, Inc.)

connection to the host computer system using standard connectivity protocols. When a user connects their handheld electronic device 201 to the host computer system via a USB cable or Bluetooth® connection, traffic that was destined for the wireless network 203 is automatically routed to the handheld electronic device 201 using the USB cable or Bluetooth® connection. Similarly, any traffic destined for the wireless network 203 is automatically sent over the USB cable Bluetooth® connection to the host computer system for processing.

The handheld electronic device 201 also includes a battery 238 as a power source, which is typically one or more rechargeable batteries that may be charged, for example, through charging circuitry coupled to a battery interface such as the serial data port 252. The battery 238 provides electrical power to at least some of the electrical circuitry in the handheld electronic device 201, and the battery interface 236 provides a mechanical and electrical connection for the battery 238. The battery interface 236 is coupled to a regulator (not shown) which provides power V+ to the circuitry of the handheld electronic device 201.

The short-range communication subsystem 262 is an additional optional component which provides for communication between the handheld electronic device 201 and different systems or devices, which need not necessarily be similar devices. For example, the subsystem 262 may include an infrared device and associated circuits and components, or a wireless bus protocol compliant communication mechanism such as a Bluetooth® communication module to provide for communication with similarly-enabled systems and devices.

A predetermined set of applications that control basic device operations, including data and possibly voice communication applications will normally be installed on the handheld electronic device 201 during or after manufacture. Additional applications and/or upgrades to the operating system 221 or software applications 225 may also be loaded onto the handheld electronic device 201 through the wireless network 203, the auxiliary I/O subsystem 250, the serial port 252, the short-range communication subsystem 262, or other suitable subsystem 264. The downloaded programs or code modules may be permanently installed, for example, written into the program memory (i.e. the flash memory 244), or written into and executed from the RAM 246 for execution by the processor 240 at runtime. Such flexibility in application installation increases the functionality of the handheld electronic device 201 and may provide enhanced on-device functions, communication-related functions, or both. For example, secure communication applications may enable electronic commerce functions and other such financial transactions to be performed using the handheld electronic device 201.

The handheld electronic device 201 may provide two principal modes of communication: a data communication mode and an optional voice communication mode. In the data communication mode, a received data signal such as a text message, an email message, or Web page download will be processed by the communication subsystem 211 and input to the processor 240 for further processing. For example, a downloaded Web page may be further processed by a browser application or an email message may be processed by the email message messaging application and output to the display 204. A user of the handheld electronic device 201 may also compose data items, such as email messages, for example, using the input devices in conjunction with the display screen 204. These composed items may be transmitted through the communication subsystem 211 over the wireless network 203.

In the voice communication mode, the handheld electronic device 201 provides telephony functions and operates as a typical cellular phone. The overall operation is similar, except that the received signals would be output to the speaker 256 and signals for transmission would be generated by a transducer such as the microphone 258. The telephony functions are provided by a combination of software/firmware (i.e., the voice communication module) and hardware (i.e., the microphone 258, the speaker 256 and input devices). Alternative voice or audio I/O subsystems, such as a voice message recording subsystem, may also be implemented on the handheld electronic device 201. Although voice or audio signal output is typically accomplished primarily through the speaker 256, the display screen 204 may also be used to provide an indication of the identity of a calling party, duration of a voice call, or other voice call related information.

The various embodiments presented above are merely examples and are in no way meant to limit the scope of this disclosure. Variations of the embodiments described herein will be apparent to persons of ordinary skill in the art, such variations being within the intended scope of the present application. In particular, features from one or more of the above-described embodiments may be selected to create alternative embodiments comprised of a sub-combination of features which may not be explicitly described above. In addition, features from one or more of the above-described embodiments may be selected and combined to create alternative embodiments comprised of a combination of features which may not be explicitly described above. Features suitable for such combinations and sub-combinations would be readily apparent to persons skilled in the art upon review of the present application as a whole. The subject matter described herein and in the recited claims intends to cover and embrace all suitable changes in technology.

The invention claimed is:

1. A key assembly for use in an electronic device, comprising:

a plurality of dome switches;

a plurality of single-piece keycaps, each keycap identifying a row of keyboard characters, each keycap having a plurality of character-representing portions separated by deforming portions, each character-representing portion being associated with a separate one of the plurality of dome switches; and a plurality of actuators for activating the dome switches, each actuator having a first side which is engaged by one of the character-representing portions of the keycap, each actuator having a second side which engages the dome switch associated with that character-representing portion, wherein, in a rest state in which the keycap is not depressed, at least some of the actuators preload at least some of the dome switches by exerting a force upon the dome switches.

2. The key assembly of claim 1, wherein the actuators preload the dome switches with a force in the range of 20 to 60 grams.

3. The key assembly of claim 1, wherein the actuators preload the dome switches with a force of approximately 40 grams.

4. The key assembly of claim 1, further comprising:

one or more connectors connecting the plurality of actuators to their associated dome switches.

5. The key assembly of claim 4 wherein, in the rest state, the one or more connectors hold the actuators in a position in which they exert a force upon their associated dome switch.

6. The key assembly of claim 1 further comprising at least one separating member disposed between adjacent keycaps, the separating member acting as a spacer to separate adjacent keycaps.

7. The key assembly of claim 6 wherein the separating members are connectors which connect the plurality of actuators to their associated dome switches.

8. The key assembly of claim 1, wherein each keycap identifies a single row of keyboard characters.

9. The key assembly of claim 1, wherein each character-representing portion identifies at least one alphanumeric character.

10. The key assembly of claim 1, wherein the character-representing portions and the deforming portions are comprised of a common material, and wherein the deforming portion has a cross section that is thinner than a cross section of the character-representing portion.

11. The key assembly of claim 1, wherein the keycap has an externally facing side and an opposed internally facing side attached to the actuators, and wherein the deforming portions are defined by grooves on the internally facing side.

12. The key assembly of claim 11, wherein the externally facing side of the keycap has a level surface across the keycap.

13. The key assembly of claim 1, wherein the keyboard characters are the characters of a QWERTY keyboard.

14. The key assembly of claim 1, wherein the plurality of actuators are comprised of rubber and wherein, in the rest state, the actuators are held in a position in which they are compressed.

15. An electronic device, comprising:

a controller for controlling the operation of the device; and a key assembly for use in an electronic device, comprising:

a plurality of single-piece keycaps, each keycap identifying a row of keyboard characters, each keycap having a plurality of character-representing portions separated by deforming portions, each character-representing portion being associated with a separate one of the plurality of dome switches; and a plurality of actuators for activating the dome switches, each actuator having a first side which is engaged by one of the character-representing portions of the keycap, each actuator having a second side which engages the dome switch associated with that character-representing portion, wherein, in a rest state in which the keycap is not depressed, at least some of the actuators preload at least some of the dome switches by exerting a force upon the dome switches.

16. The electronic device of claim 15, wherein the actuators preload the dome switches with a force in the range of 20 to 60 grams.

17. The electronic device of claim 15, wherein the actuators preload the dome switches with a force of approximately 40 grams.

18. The electronic device of claim 15, further comprising: one or more connectors connecting the plurality of actuators to their associated dome switches.

19. The electronic device of claim 18 wherein, in the rest state, the one or more connectors hold the actuators in a position in which they exert a force upon their associated dome switch.

20. The electronic device of claim 15 further comprising at least one separating member disposed between adjacent keycaps, the separating member acting as a spacer to separate adjacent keycaps.

21. The electronic device of claim 20 wherein the separating members are connectors which connect the plurality of actuators to their associated dome switches.

* * * * *